US005088605A

United States Patent [19]

Nales

[11] Patent Number: 5,088,605

[45] Date of Patent: Feb. 18, 1992

[54] DEVICE FOR STORING DISH-TYPE CONTAINERS

[76] Inventor: Arnoldus T. B. M. Nales, Herpjeskamp 13, 7396 CA, Terwolde, Netherlands

[21] Appl. No.: 617,521

[22] Filed: Nov. 15, 1990

[30] Foreign Application Priority Data

Nov. 27, 1989 [NL] Netherlands ..... 8902919

[51] Int. Cl.[5] ..... A47G 19/00

[52] U.S. Cl. ..... 211/41; 211/208; 211/205

[58] Field of Search ..... 211/41, 71, 205, 208

[56] References Cited

U.S. PATENT DOCUMENTS

| | | | |
|---|---|---|---|
| 1,089,290 | 3/1914 | Thompson | 211/205 X |
| 1,348,792 | 8/1920 | Feingold | 211/41 |
| 1,652,114 | 12/1927 | Gestrine | 211/41 X |
| 2,456,535 | 12/1948 | Rundell | 211/71 X |
| 3,204,779 | 9/1965 | Warner | 211/205 X |
| 4,354,603 | 10/1982 | Dunn | 211/41 X |
| 4,368,822 | 1/1983 | Kramer et al. | 211/41 |
| 4,589,556 | 5/1986 | Peretz | 211/41 |
| 4,778,064 | 10/1988 | Gold | 211/41 |
| 4,911,308 | 3/1990 | Nylund | 211/41 |
| 4,936,472 | 6/1990 | Meier | 211/41 X |

FOREIGN PATENT DOCUMENTS

| | | | |
|---|---|---|---|
| 0466971 | 12/1951 | Italy | 211/41 |
| 0273434 | 7/1927 | United Kingdom | 211/205 |
| 0340490 | 12/1930 | United Kingdom | 211/41 |

*Primary Examiner*—Alvin C. Chin-Shue
*Assistant Examiner*—Sarah A. Lechok
*Attorney, Agent, or Firm*—Edmund M. Jaskiewicz

[57] ABSTRACT

Device for storing dish-type containers such as plates, dishes or serving trays containing a product, with a vertical column which has a base support at the bottom side, the column being triangular or rectangular in cross-section and provided at each side with supporting elements placed at equal intervals above one another. Each supporting element comprises two pin-shaped projections lying in line with each other in the horizontal direction, and a third pin-shaped projection which is longer than the other two projections and lies cenrally between the other two projections at a certain distance from the line connecting the other two projections to each other. The distance from the bottom projection to the connecting line between the two upper projections is adjustable. The base support for the column comprises a flat bottom plate provided with wheels, which plate is provided with one or more fixing elements for detachable accommodation of the column.

9 Claims, 3 Drawing Sheets

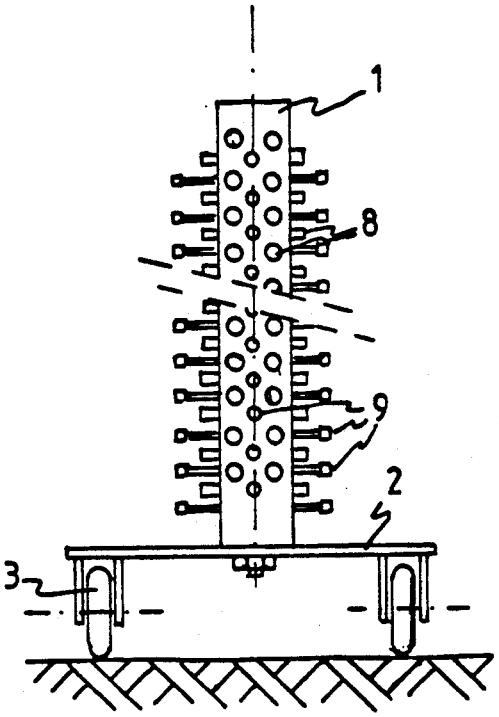
Fig: 1
Fig: 2
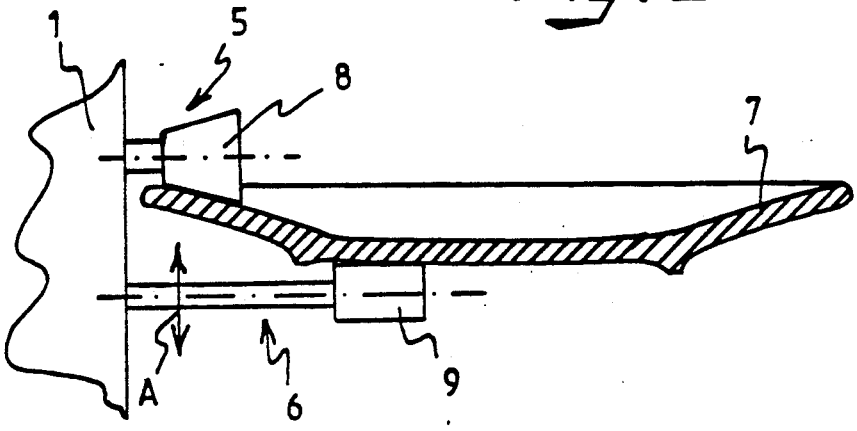

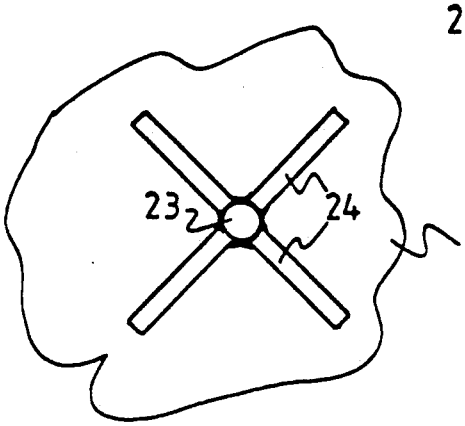
Fig: 4 A
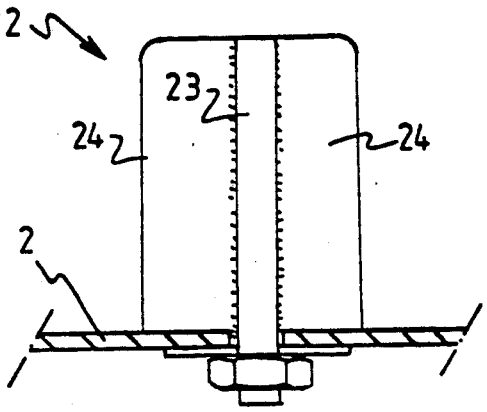
Fig: 4 B
Fig: 5
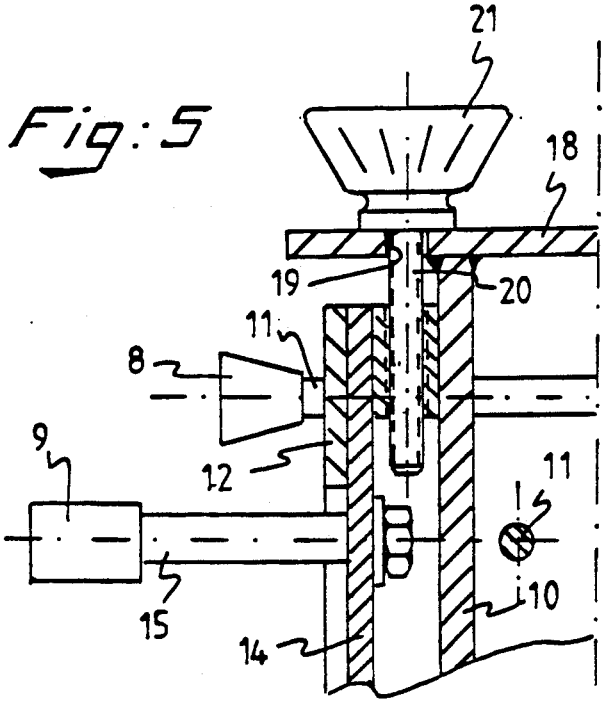

DEVICE FOR STORING DISH-TYPE CONTAINERS

The invention relates to a device for dish-type containers such as plates, dishes or serving trays containing a product. The invention relates in particular to a device for storing plates with a finished product or a semi-finished product in a refrigerator or freezer. It is vitally important here that as many plates as possible are stored per unit area.

Hitherto, mobile racks in which the plates or serving trays were placed were used for this purpose. These racks with serving trays occupy a large amount of space even when they are not in use.

The object of the invention is then to provide a device which meets the above-mentioned requirements and when not in use can be stored without taking up a large amount of space.

These objects are achieved according to the invention in that the device is formed by a vertical column which has a base support at the bottom side, the column being provided with supporting elements placed at equal intervals above one another for the accommodation of the containers.

With such a device it is possible to prepare a large number of plates in advance and, for example, to provide them with the same type of first course or dessert, which can then be served in a short time. A number of dishes can also be partially prepared in advance and then stored in, for example, the refrigerator or the freezer.

The column of the device is preferably triangular or rectangular in cross-section, and is provided on each side with supporting elements placed at equal intervals above one another, and each supporting element comprises two pinshaped projections lying in line with each other in the horizontal direction, and a third pin-shaped projection which is longer than the other two projections and lies centrally between the other two projections at a certain distance from the line connecting the other two projections to each other.

In this way plates or dishes can engage with an edge between the projections, the bottom projection always supporting the bottom side of the plate or the dish, and the two top projections holding the plate in balance.

In an expedient embodiment of the invention the distance from the bottom projection to the connecting line between the two top projections is adjustable. This design makes it possible to adapt the device to the depth of the plates or dishes in question and to the different dimensions and shapes thereof.

The invention will be explained in greater detail with reference to the drawing which by way of example shows an embodiment of the invention, in which:

FIG. 1 shows schematically a side view of the device according to the invention;

FIG. 2 shows schematically on a larger scale a supporting element of the device according to FIG. 1 with a plate accommodated therein;

Figure 3:
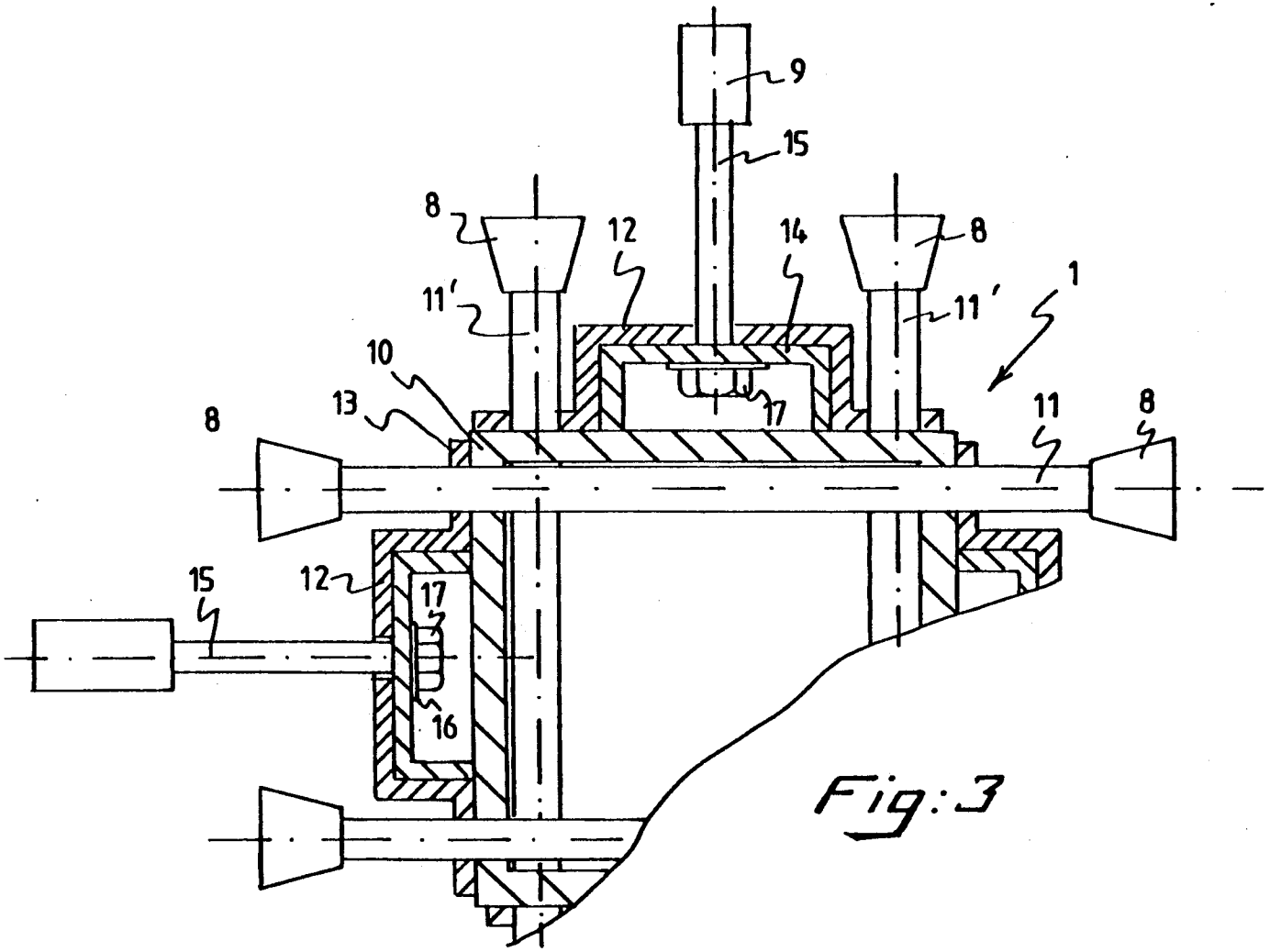
FIG. 3 shows a partial horizontal section of the device according to FIG. 1.

FIG. 4*a* and 4*b* show a top and a side view respectively of a fixing element for fixing the column to the base support;

FIG. 5 shows a vertical section of the top part of the column, the mechanism for adjusting the supporting elements can be seen.

As can be seen from FIG. 1, the device comprises a column 1 which has a base plate 2 at the bottom side. The base plate has a square surface, and in each of the corners is provided with a wheel 3 by means of which the device is mobile. Two of the wheels are preferably castors, as a result of which the device can be moved easily.

In the embodiment shown, the column 1 has an essentially square cross-section, provision being made for supporting elements 4 at equal intervals above one another at each of the sides of the column, which supporting elements will be described in detail below, and serve to accommodate plates or dishes.

FIG. 2 shows schematically how a plate is suspended horizontally in a supporting element 4. As can be seen in FIGS. 1 and 2, each supporting element comprises two pinshaped projections 5 lying in line with each other in the horizontal direction, and a third pin-shaped projection 6 lying centrally between the two projections 5 at a distance below the line connecting the projections to each other. A plate 7, which can contain a finished product or semi-finished product, is inserted with its edge below the two projections 5 and rests with its lower side on the projection 6. For this purpose, the projection 6 is considerably longer than the projections 5. In order to ensure a stable suspension of the plate, the upper projections 5 are provided at their free ends with rubber caps 8 which are the shape of a truncated cone and are fitted in such a way that the large base surface faces outwards. The slightly upward-running edge of the plate or the dish thus lies well against the conical surface of the cap 8. The lower projection 6 is also provided at its free end with a rubber cap 9, but this cap is a cylindrical shape. In order to make the device suitable for plates and dishes of different dimensions and shapes, the lower projection 6 can be moved in the vertical direction relative to the upper projections 5, as shown by the double arrow A in FIG. 2.

FIG. 3 shows a vertical section of the column 1 containing the supporting elements 4. The column 1 is essentially formed by a tube 10 with square cross-section. Through this tube project horizontal pins 11, which are fitted in such a way that two pins always lie parallel to each other in the same horizontal plane, and extend at right angles to two side surfaces of the tube 10 lying opposite each other. The pins 11, 11' lying in the same horizontal plane lie as far away from each other as possible, in other words near the corner points of the tube. Viewed in the lengthwise direction of the tube, two pins 8 thus always lie spaced apart through two opposite side faces of the tube 10, while two pins 11' always run in the same way staggered over half the distance through the other side faces of the tube 10, in the present case thus intersecting the pins 11 at right angles. The pins 11 and 11' are fixed in the tube 10 in a suitable manner (not shown), for example by gluing. Both ends of each pin are provided with the rubber cap 8.

Each of the side surfaces of the tube 10 is provided with a guide section 12 extending over virtually the entire length of the tube 10. This guide section is U-shaped in cross-section with outward-flanged end flanges 13, by means of which the sections are fixed to the tube. A bar 14 is fitted inside the space enclosed by the guide section, which bar 14 is guided by the guide section so that it slides in the lengthwise direction. The bar 14 bears at equal intervals a number of pins 15 projecting through a longitudinal aperture 16 provided in the guide section. In the embodiment shown in FIG. 3 the pins 16 are fixed to the bar 14 by means of a bolt 17. The distance between the pins 15 corresponds to the vertical distance between every two pins 11 and 11'. Each pin 15 with the two pins 11, 11' lying directly above it forms a supporting element 4, for which purpose each pin 15 is provided with a rubber cap 9 at the free end. The distance between the pin 15 and the pins 11, 11' lying above it can be altered by means of the slidable bar 14, in order to adapt the supporting element to the plates or dishes which are to be stored.

FIG. 5 shows schematically the way in which the adjustment of the supporting elements can be carried out. For this, a cover plate 18 which projects beyond the tube at the sides and at least overlaps the guide section 12 is fitted on the top side of the tube 10. In line with the bar 14, the cover plate 18 is provided with an aperture 19, through which an externally threaded rod 20 is inserted. The rod 20 is provided with a turning knob 21 at the end lying above the cover plate, and at the other end is connected by a threaded connection to the bar 14. Turning the knob 21 by hand will thus result in vertical displacement of the bar 14 in the guide section 12.

Finally, FIGS. 4*a* and 4*b* show the fixing element 22, by means of which the column 1 can be fixed to the base plate. The fixing element 22 comprises a rod 23 to which plates 24 are welded diametrically, which plates lie at right angles to each other. The rod projects beyond the plates 24 at one end, and this projecting part is threaded. In order to fix the fixing element to the base plate 2, the threaded end of the rod 23 is inserted into an aperture provided in the base plate and fixed by means of a nut 25. The column 1 is placed over the fixing element, the fixing element engaging in a tight fit in the internal cavity of the tube 10. The fixing element, and thus the column 1, can be fixed at any desired place on the base plate through providing a number of holes in the base plate.

This device can also be used very well with, for example, serving trays, for which purpose the column can then be fixed to the side of the base plate 2. For this, the base plate is provided with a second fixing element on which the column can be fixed. This means that a number of serving trays can then be placed at one side of the column, provided with, for example, cups and saucers which are to be served with, for example, coffee.

Other possibilities with the device according to the invention are to anchor the column firmly to the base plate by means of an L-shaped bar which is fixed to the side of the base plate, and one leg of which runs parallel to the column 1, while the other leg is fixed to the top side of the column. This L-shaped bar can then be used for fitting a casing in such a way that it pivots about the column, so that a closed trolley is produced. Refrigeration, for example at the top side, and/or a heating unit, for example at the bottom side, can then be provided. Such a trolley can then be used independently of a refrigerator or an oven.

Other accessories can also be supplied in a simple manner, for example a support which can be placed on a number of the supporting elements, and on which, for example, standardized cutlery trays can be placed.

I claim:

1. Device for storing dish-type containers such as plates, dishes or serving trays containing a product, comprising a vertical column which has a base support at the bottom side thereof, said column having a plurality of supporting elements disposed at equal intervals above one another for the accommodation of the containers in horizontal position, said column being triangular or rectangular in cross section to define a plurality of sides thereon and said supporting elements placed on each side thereof at equal intervals above one another, each said supporting element comprises two pin-projections lying in line with each other in the horizontal direction, and a third pin-shaped projection which is longer than the other two projections, and lies centrally below the other two projections at a predetermined distance below the line connecting the other two projections to each other.

2. Device according to claim 1, wherein the distance from the bottom projection to the connecting line between the two upper projections is adjustable.

3. Device according to claim 1, wherein the supporting elements are staggered relative to each other in the vertical direction at the sides of the column adjacent to each other over a distance which corresponds to half the vertical distance between the supporting elements situated at one side.

4. Device according to claim 1, wherein the two upper pin-shaped projections are provided at their free ends with an end part widening outwards.

5. Device according to claim 1, wherein the base support for the column comprises a flat bottom plate provided with wheels, which plate is provided with one or more fixing elements for detachable accommodation of the column.

6. Device according to claim 1, wherein the third pin-shaped projections of all supporting elements always provided at one side of the column are adjustable in common.

7. Device according to claim 1, wherein the bottom plate is square, and two fixing elements are present, one of which lies in the centre, while the other is situated near the side edge of the bottom plate.

8. Device according to claim 1, wherein the pin-shaped projections of each supporting element are provided at their free ends with a cap made of an elastomer.

9. Device according to claim 8, wherein the column is made of a hollow tube, and the fixing elements are formed by raised elements which engage in the internal cavity of the tube.

* * * * *